US007786832B2

(12) United States Patent
Lin

(10) Patent No.: US 7,786,832 B2
(45) Date of Patent: Aug. 31, 2010

(54) INDUCTOR WITH INSULATIVE HOUSING AND METHOD FOR MAKING THE SAME

(75) Inventor: Chih-Min Lin, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 447 days.

(21) Appl. No.: 11/810,263

(22) Filed: Jun. 5, 2007

(65) Prior Publication Data

US 2007/0279171 A1 Dec. 6, 2007

(30) Foreign Application Priority Data

Jun. 5, 2006 (TW) ..... 95119838 A

(51) Int. Cl.
*H01F 27/06* (2006.01)
*H01F 27/02* (2006.01)
*H01F 5/00* (2006.01)
*H01F 27/28* (2006.01)

(52) U.S. Cl. ..... 336/90; 336/65; 336/83; 336/96; 336/200; 336/232

(58) Field of Classification Search ..... 336/65, 336/83, 90, 96, 200, 232
See application file for complete search history.

(56) References Cited

U.S. PATENT DOCUMENTS

| | | | | |
|---|---|---|---|---|
| 5,307,041 | A * | 4/1994 | Kato et al. | 336/83 |
| 5,751,203 | A | 5/1998 | Tsutsumi | |
| 6,392,519 | B1 * | 5/2002 | Ronning | 336/90 |
| 6,747,538 | B2 * | 6/2004 | Kuwata et al. | 336/83 |
| 2002/0190829 | A1 * | 12/2002 | Chang et al. | 336/65 |

* cited by examiner

*Primary Examiner*—Elvin G Enad
*Assistant Examiner*—Ronald W Hinson
(74) *Attorney, Agent, or Firm*—Ming Chieh Chang; Wei Te Chung; Andrew C. Cheng

(57) ABSTRACT

An inductor (100) includes a magnetic core (30) and an insulative housing (10). The magnetic core has a wire wound (40) around a central portion (33) thereof, a projecting portion (31) formed on a lower end thereof and a stepped-portion (321) extending downwardly from the projecting portion. The insulative housing encloses the stepped-portion and the projecting portion of magnetic core to thereby integrate the insulative housing and the magnetic core together by insert molding.

2 Claims, 2 Drawing Sheets

INDUCTOR WITH INSULATIVE HOUSING AND METHOD FOR MAKING THE SAME

BACKGROUND OF THE INVENTION

1. Field of the Invention

The present invention relates to an inductor and a method for producing the same.

2. Description of Prior Arts

U.S. Pat. No. 5,751,203 issued on May 12, 1998, discloses such a conventional inductor for a battery-driven electronic device. The inductor comprises a terminal table, a magnetic core, and a plurality of L-shaped conductors inserted through the terminal table. The terminal table has two stepped-up portions formed on a top surface thereof. Each stepped-up portion has a pair of projecting portions formed at the corners thereof. The magnetic core includes at least a drum-shaped core having a wire wound around a central part thereof and defines a recess on a bottom surface thereof. During assembly, the magnetic core is positioned on the terminal table by inserting the projecting portion of the terminal table into the recess of drum-shaped core. At the same time, the outer circumferential surface of the bottom flange of the drum-shaped core is mating with a curved inner side surface of the stepped-up portions.

However, the assembly of the inductor increases the cost of manufacturing the inductor. Additionally, the engagement between the magnetic core and the terminal table is unreliable.

Hence, it is desirable to provide an improved inductor to overcome the aforementioned disadvantages.

SUMMARY OF THE INVENTION

An object of the present invention is to provide an inductor having a stable configuration. Another object of the present invention is to provide a method of easily producing the inductor having a strengthened configuration.

To achieve the above object, an inductor comprises a magnetic core and an insulative housing. The magnetic core has a wire wound around a central portion thereof, a projecting portion formed on a lower end thereof and a stepped-portion extending downwardly from the projecting portion. The insulative housing encloses the projecting portion of magnetic core to thereby integrate the insulative housing and the magnetic core together by inserting molding.

Advantages of the present invention are to provide an inductor comprises the insulative housing enclosing the stepped-portion to integrate with the magnetic core by inserting molding to thereby strengthen the engagement between the magnetic core and the insulative housing and to ease the assembly of the inductor.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
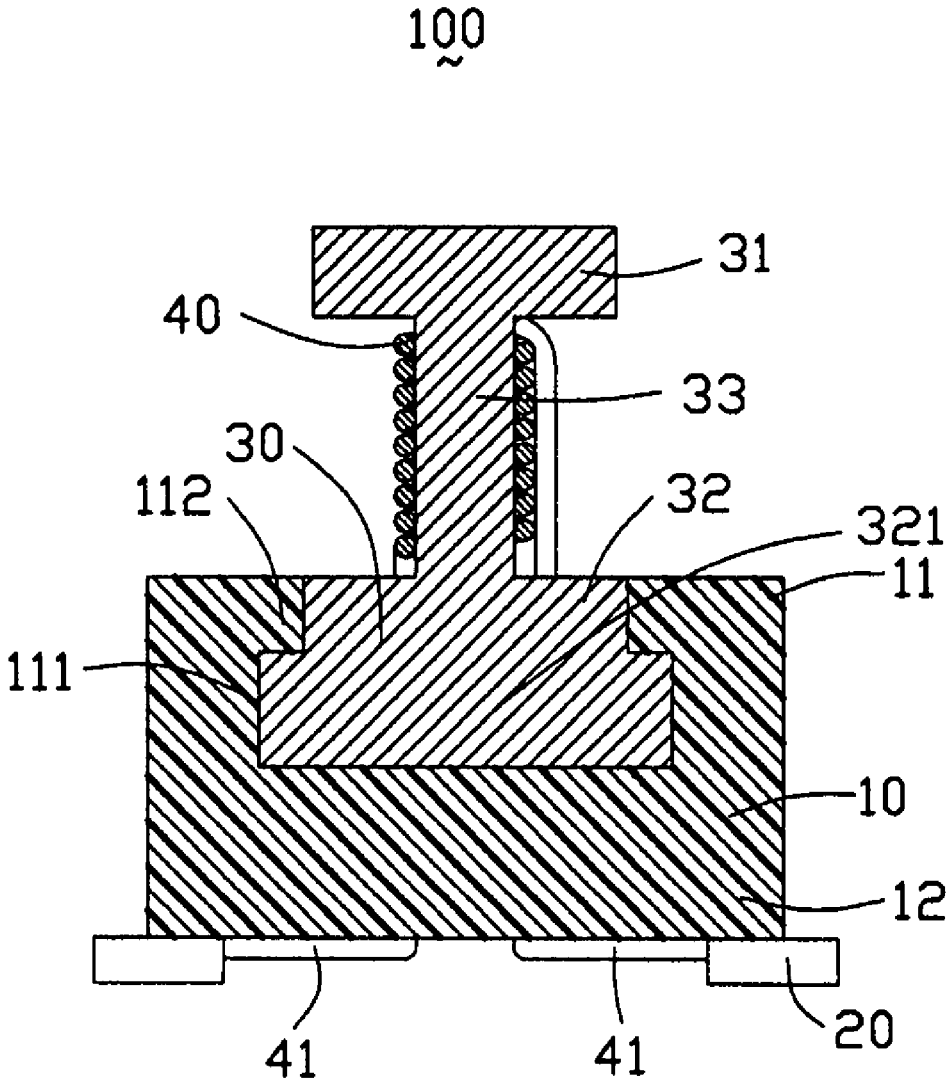
FIG. 1 is a cross-sectional view of an inductor in accordance with one embodiment of the present invention.

Reference will now be made to the drawing figures to describe the present invention in detail. Referring to FIG. 1 an inductor 100 in accordance with the present invention comprises a magnetic core 30 and an insulative housing 10.

The magnetic core 30 has a first projecting portion 31 and a second projecting portion 32 respectively formed on an upper and lower ends thereof, and a stepped-portion 321 extending downwardly from the second projecting portion 32. The magnetic core 30 further has a central portion 33 formed between the first and second projecting portions 31, 32. The central portion 33 is wound around by a wire 40 which is made from copper material covered with an insulative material. The first and second projecting portions 31, 32 have substantially same diameter. The central portion 33 has a diameter much smaller than that of the first projecting portion 31.

The insulative housing 10 comprises a base portion 12, an engaging portion 11 and a mating portion 112 inwardly projecting from an upper portion of the engaging portion 11 for engaging with the magnetic core 30. The engaging portion 11 upwardly extends from the base portion 12 to form a receiving space 111 surrounded by the engaging portion 11 for receiving the stepped-portion 321. In anther embodiment, the insulative housing 10 has a plurality of receiving spaces 111 for engaging with a plurality of stepped-portions 321 extending from the magnetic core 30.

A plurality of conductive pads 20 are soldered to a bottom surface of the base portion of the insulative housing 12 and adopted for contacting with ends 41 of the wire 40 and engaging with a printed circuit board (not shown).

Figure 2:
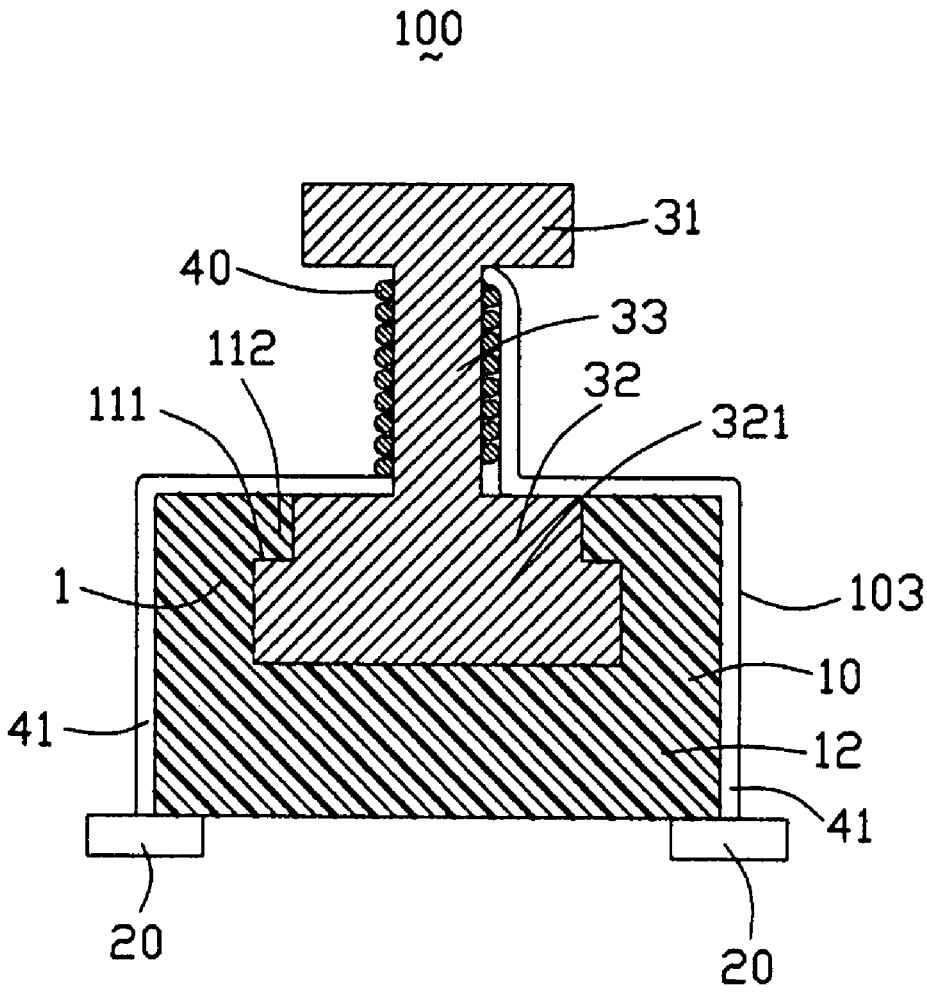
FIG. 2 is a cross-sectional view of an inductor of another embodiment.

In assembling the conductor 100, the insulative housing 10 is integrated with the magnetic core 30 by insert molding. The stepped-portion 321 is received in the receiving space 111. The mating portion 112 engages with the second projecting portion 32 for fixing the magnetic core 30. The insulative housing 10 encloses the second projecting portion 32 and the stepped-portion 321 of magnetic core 30. The wire 40 extends through the insulative housing 10 and then the ends 41 of the wire 40 are connected with the pads 20 as shown in FIG. 1. In another embodiment as shown in FIG. 2, the wire 40 extends outside 103 of the insulative housing 10 in a top-to-bottom direction for connecting with the pads 20. Finally, the conductive pads 20 of the conductor 100 are electrically connected with a circuit board (not shown).

In accordance with the present invention, the conductive pads 20 of the inductor 100 are electrically connected with the circuit board via the technology of SMT (Surface Mounting Technology). Optionally, other technologies could be used to connect conductive pads 20 with the circuit board. The insulative housing 10 is made from heat-resistant material such as LCP (Liquid Crystalline Polymer) for preventing the inductor 100 from distortion. Understandably, the inductor 100 could be made from other material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inductor comprising:

a magnetic core having a wire wound around a central portion thereof, a projecting portion formed on a lower end thereof, and a stepped-portion extending downwardly from the projecting portion and having a diameter different from that of the projecting portion; and an insulative housing enclosing and engaging with the stepped-portion and the projecting portion of the magnetic core to thereby integrate the insulative housing and the magnetic core together as a whole, said insulative housing comprising a base portion, an engaging portion upwardly extending from the base portion to surround a receiving space for receiving the stepped-portion, and a mating portion projecting inwardly from an upper portion of the engaging portion for engaging with the projecting portion of the magnetic core, said housing being almost flush with an upper surface of the projecting portion.

2. An inductor comprising:

a magnetic core having a wire wound around a central portion thereof, a projecting portion formed on a lower end thereof, and a recessed portion formed in the projecting portion; and an insulative housing enclosing the projecting portion and filling said recessed portion so as to integrate the insulative housing and the magnetic core together as a whole; wherein said recessed portion is located in a periphery of said projecting portion; wherein said projecting portion forms a stepped structure beside said recessed portion.

* * * * *